United States Patent [19]

Hultåker

[11] Patent Number: 4,929,928

[45] Date of Patent: May 29, 1990

[54] MAGNETIZED INK, PAINT OR DYE USED ON MERCHANDISE TO PREVENT THEFT

[75] Inventor: Eric Hultåker, Västerås, Sweden

[73] Assignee: AB Aros Avancerad Butikskontroll, Västerås, Sweden

[21] Appl. No.: 157,983

[22] Filed: Feb. 19, 1988

[30] Foreign Application Priority Data

Feb. 20, 1987 [SE] Sweden ..... 870713-4

[51] Int. Cl.[5] ..... G08B 13/14

[52] U.S. Cl. ..... 340/572; 235/493; 340/568

[58] Field of Search ..... 340/568, 571, 572; 235/493

[56] References Cited

U.S. PATENT DOCUMENTS

| | | | |
|---|---|---|---|
| 3,725,895 | 4/1973 | Hayes | 340/572 |
| 4,042,807 | 8/1977 | Donabin et al. | 235/480 |
| 4,063,229 | 12/1977 | Welsh et al. | 340/571 |
| 4,438,462 | 3/1984 | Koester et al. | 235/493 |
| 4,568,921 | 2/1986 | Pokalsky | 340/572 |
| 4,574,274 | 3/1986 | Pinneo | 340/572 |
| 4,575,624 | 3/1986 | Klinkhardt | 235/493 |
| 4,581,524 | 4/1986 | Hoekman et al. | 340/572 |
| 4,652,863 | 3/1987 | Hultman | 340/572 |
| 4,717,438 | 1/1988 | Benge et al. | 340/572 |

OTHER PUBLICATIONS

"Means for Replicating Magnetic, Images & Bar Codes", *IBM Tech. Discl. Bulltn.*, R. A. Meyers, vol. 20, #5, Oct. 1977.

*Primary Examiner*—Joseph A. Orsino
*Assistant Examiner*—J. D. Jackson
*Attorney, Agent, or Firm*—Dennison, Meserole, Pollack & Scheiner

[57] ABSTRACT

The invention relates to a procedure for applying an anti-theft device on goods, and ink/dye/paint for use therewith. The ink to be applied on the goods is mixed with magnetizable particles, the particles being magnetized, and demagnetization being effect upon payment or leaving the premises. An alarm signal is emitted if a marked article which has not been demagnetized, is taken out.

12 Claims, 1 Drawing Sheet

MAGNETIZED INK, PAINT OR DYE USED ON MERCHANDISE TO PREVENT THEFT

BACKGROUND OF THE INVENTION

The present invention relates to a procedure for applying an anti-theft device on goods, and ink/dye/paint for performing the procedure. Considerable problems are encountered in trade, distribution and manufacture concerning theft, and various systems are generally used to prevent and/or make theft and shop-lifting more difficult. Lockable hangers and alarm buttons exist in the clothes trade, for instance, the button activating an alarm if it remains on a garment passing an exit. Today's systems are far too costly for less valuable goods and for goods with a current value of less than, e.g. 25:- SEK, it is not worth using alarm buttons of the current design.

SUMMARY OF THE INVENTION

The present invention, based partially on known technology, constitutes a solution to these and other associated problems. The procedure according to the invention is characterised in that ink, particularly printer's ink, containing magnetizable particles is applied, e.g. printed on the goods, that the particles are magnetized, e.g. at the time of printing, and that the marking is demagnetized at a control point or when scanned, e.g. upon payment at a cashdesk and/or leaving the premises. Any thefts are thus effectively controlled and in the event of anyone trying to leave without having paid, an alarm signal may be emitted at the exit. A marking which has not been demagnetized can be sensed in known manner when magnetized particles pass a certain sensing point or scanning point, whereupon an alarm signal can be triggered.

DESCRIPTION OF THE PREFERRED EMBODIMENTS

The invention relates both to a procedure for utilizing a magnetizable ink for detecting theft, and to an ink for use with the this procedure. The ink is characterised in that it contains particles of magnetizable material intended to be magnetized when the ink is applied on an article or on already applied ink.

In the manufacture of such ink a colour pigment is added, such as zinc white, etc. having a certain particle size. Printer's ink is generally used for price-marking goods and packs, either on labels or directly on the package in the form of a bar-code, for instance. The price is usually scanned with a movable "pen" or by the price marking being moved past a stationary scanning station. According to the invention magnetic particles are added to the printer's ink. These may be of normal permanent magnet material, e.g. Alnico type, oxide magnet or the like.

Up until the time of printing the particles are non-magnetic (non-magnetic in the ink). The particle size is adjusted to the particle size of the color pigment. The ink is magnetized at the time of applying the label and marking the package. The particles are demagnetized when scanned by a "pen" or at a fixed station. Scanning may be performed at the same time as price-scanning or at a separate station arranged e.g. at the exit (preferably hidden).

Figure 1:
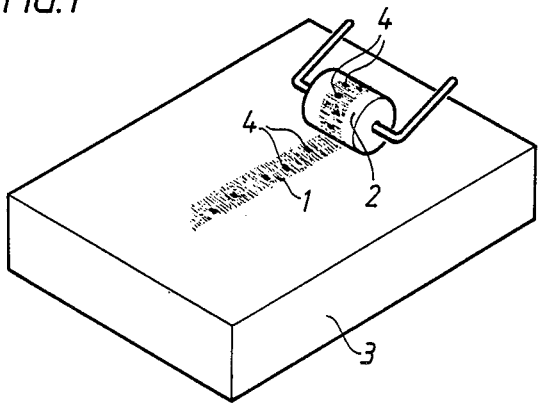
FIG. 1 is a perspective view of the application of a magnetizable paint to an article according to the procedure of the invention.

As shown in FIG. 1, a paint 1 mixed with magnetizable particles 4 is applied from a roller 2 to a package 3. The roller 2 also serves the function of magnetizing particles 4.

Figure 2:
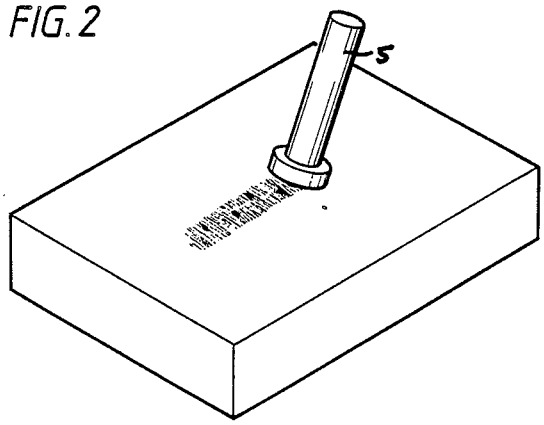
FIG. 2 is a perspective view of the demagnetization of the paint according to the procedure of the invention.

As shown in FIG. 2, a demagnetization device 5 is applied to the magnetized particles at the time of payment for the articles at a cash desk.

The method according to the invention can also be used for a number of goods packed in a box, on a pallet or in some other package and demagnetization may be effected for a complete package, e.g. if the whole package cannot be given a common anti-theft marking. In this case stronger energy impulses should be used for demagnetizing than would ordinarily be used for a single article.

Various types of magnetizable particles may be used in the ink, having different properties with respect to permeability, particle size, etc., and combining the two or more kinds gives increased control possibilities such as identification of the various anti-theft-marked goods, different measures for different types of stolen goods, etc.

As mentioned, individual items in a package such as a large box, a loading pallet, etc. can be marked and demagnetization may be effected either of the common marking for the whole package or at the same time for the individual products in the package. The ink may even be applied on the box or wrapping before the goods are packed or wrapped.

As mentioned, demagnetization may be performed at the same time as price-scanning. Price marking may be performed in conventional manner by means of energy pulses governed by a computer and operating on the positioning principle. This may also apply to the magnetization. The energy impulse for magnetization may be an electrical field or laser field, for instance. Magnetizing may also be performed separately from price marking.

The method and ink/dye/paint described above can be varied in many ways within the scope of the following claims.

What is claimed is:

1. A printing medium selected from the group consisting of ink, dye and paint for use in applying an anti-theft marking to articles, said printing medium containing particles of at least two different magnetizable materials, said materials differing in permeability and/or particle size, wherein said particles are intended to be magnetized when the printing medium is applied on an article or on a layer of a printing medium already applied to an article.

2. A procedure for applying and utilizing an anti-theft marking on goods comprising the steps of applying to the goods a printing medium selected form the group consisting of ink, dye, and paint containing particles of at least two different magnetizable materials, said materials differing in permeability and/or particle size, magnetizing the particles, and subsequently demagnetizing the particles of the marking at a control station upon payment at a cashdesk or leaving a premises.

3. A procedure for applying and utilizing an anti-theft marking on articles, comprising the steps of applying a printing medium selected from the group consisting of ink, dye and paint and containing megnetizable particles to each of a plurality of articles, loading said articles in boxes, on pallets, or in some other package, magnetizing the particles of said printing medium for all said articles as a group, and subsequently demagnetizing the particles of the marking for each of said plurality of articles individually at a control station upon payment at a cashdesk and/or leaving a premises.

4. A procedure for applying and utilizing an anti-theft marking on articles, comprising the steps of applying a printing medium selected from the group consisting of ink, dye and paint and containing magnetizable particles to each of a plurality of articles, loading said articles in boxes, on pallets, or in some other package, magnetizing the particles of said printing medium, and subsequently demagnetizing the particles of the marking for said plurality of articles at a control station upon payment at a cashdesk and/or leaving a premises.

5. A procedure according to claim 4 or 3 wherein said printing medium is applied directly to the surface of said articles.

6. A procedure according to claim 4 or 3, additionally comprising the step of sensing magnetized particles as said articles leave a premises, and triggering an alarm when magnetized particles are sensed.

7. A procedure according to claim 4 or 3, wherein said magnetizable particles comprise permanent magnet materials.

8. A procedure according to claim 4, wherein said step of magnetizing takes place separately for each of said plurality of articles.

9. A procedure according to claim 4, wherein said step of magnetizing takes place together for said plurality of articles.

10. A procedure according to claim 4, wherein said demagnetization step utilizes energy impulses which are stronger than those which would be utilized for demagnetizing a single one of said plurality of articles.

11. A procedure according to claim 4, wherein magnetizing is performed in conjunction with price-marking and demagnetizing is effected in conjunction with a step of scanning said price marking for payment at a cashdesk.

12. A procedure according to claim 11, wherein demagnetization is effected by a movable pen or in a stationary scanning station.

* * * * *